US009053692B2

(12) United States Patent
Read et al.

(10) Patent No.: US 9,053,692 B2
(45) Date of Patent: Jun. 9, 2015

(54) MULTI CHANNEL DIGITAL WIND INSTRUMENT

(71) Applicants: Wayne Richard Read, Kittery, ME (US); Deidre Hebert, Dover, NH (US)

(72) Inventors: Wayne Richard Read, Kittery, ME (US); Deidre Hebert, Dover, NH (US)

( * ) Notice: Subject to any disclaimer, the term of this patent is extended or adjusted under 35 U.S.C. 154(b) by 163 days.

(21) Appl. No.: 13/671,421

(22) Filed: Nov. 7, 2012

(65) Prior Publication Data

US 2013/0192446 A1 Aug. 1, 2013

Related U.S. Application Data

(60) Provisional application No. 61/628,772, filed on Nov. 7, 2011.

(51) Int. Cl.
*G10H 1/06* (2006.01)
*G10H 1/02* (2006.01)
*G10H 1/00* (2006.01)

(52) U.S. Cl.
CPC ..... *G10H 1/02* (2013.01); *G10H 1/0066* (2013.01); *G10H 2220/315* (2013.01); *G10H 2220/361* (2013.01); *G10H 2230/211* (2013.01)

(58) Field of Classification Search
CPC ..... H04R 1/08; H04R 3/00; G10H 1/0066; G10H 1/02; G10H 2220/315; G10H 2220/361; G10H 2230/211; G11B 27/105
See application file for complete search history.

(56) References Cited

U.S. PATENT DOCUMENTS

| | | | | |
|---|---|---|---|---|
| 4,119,007 | A | 10/1978 | Criglar et al. | |
| 4,252,045 | A | 2/1981 | Nagura | |
| 4,566,363 | A * | 1/1986 | Arai | 84/711 |
| 4,984,499 | A * | 1/1991 | Schille | 84/734 |
| 5,245,130 | A * | 9/1993 | Wheaton | 84/742 |
| 6,326,532 | B1 * | 12/2001 | Antaki | 84/377 |
| 6,383,536 | B1 * | 5/2002 | Palmer et al. | 426/104 |
| 6,538,189 | B1 * | 3/2003 | Ethington | 84/615 |
| 8,497,760 | B2 * | 7/2013 | Whalen et al. | 340/4.1 |
| 8,653,346 | B2 * | 2/2014 | Schaman | 84/377 |

* cited by examiner

*Primary Examiner* — Marlon Fletcher

(57) ABSTRACT

An electronic musical instrument whose operation is similar to a harmonica, and which can be played easily by anyone familiar with a harmonica. The instrument measures positive or negative pressure at the mouthpiece, with a MEMS (Micro-electro-mechanical system) pressure sensor, which produces an electronic signal, which is then converted to pre-sampled sounds of a variety of instruments via an on-board synthesizer, and is capable of sending MIDI (Musical Instrument Digital Interface) signals to control other electronic musical instruments or devices.

20 Claims, 4 Drawing Sheets

MULTI CHANNEL DIGITAL WIND INSTRUMENT

BACKGROUND OF THE INVENTION

1. Field of the Invention

This invention relates to an electronic musical instrument capable of reproducing much of the feel of a harmonica, while providing the capacity to reproduce the sound of most any other instrument.

2. Description of Related Art

Prior technologies have considered the possibility of reproducing sound by means of measuring movement of reeds in a harmonica via optical or magnetic means. Antaki, U.S. Pat. No. 6,326,532.

Other instruments have utilized flow sensors, requiring a mechanism within the air stream. Wheaton, U.S. Pat. No. 5,245,130; Schille, U.S. Pat. No. 4,984,490.

Pressure-transducers have been considered in the past as components in a wind instrument, to measure vibrations within the air column. Criglar, et al., U.S. Pat. No. 4,119,007.

In the past, mouth-pieces have been designed with separate passages for blow and draw. Nagura, U.S. Pat. No. 4,252,045.

Prior attempts at creating an electronic harmonica have resulted in a device requiring external sound synthesis via wire or radio emissions.

Based on the foregoing, there is a need in the art for a device that reproduces sound without reeds, airflow through a sensor, or moving parts in the air stream. Further, there is a need for a device for reproducing sound that uses an ambient-referenced pressure sensor, eliminating the need for separate passages and sensors, making the mouth-piece that is simple in design. Furthermore, there is a need for a device that is capable of triggering and controlling the dynamics of a synthesized sound. Finally, there is a need in the art for an electronic musical instrument that synthesizes sound within the body of the instrument, rather than requiring external sound synthesis.

SUMMARY OF THE INVENTION

In an embodiment of the present invention, a musical instrument has micro-electro-mechanical system (MEMS) pressure sensors that translate an air pressure to an electrical voltage; a mouthpiece, with air passages and vent holes, to channel air to the pressure sensors; a digital to analog converter to measure an electrical output of the pressure sensors; a user interface that allows a user to control the instrument; a microprocessor, that reads an electronic signal from the pressure sensors; a software program, that directs the microprocessor to perform a specific operation; an on-board sound-synthesis system that converts the electronic signal to sounds of a variety of instruments; a battery that provides power to the instrument; a charging system that charges the battery; and a drip tray beneath the mouthpiece that retains moisture escaping from the vent holes.

In an embodiment, the mouthpiece is removable and replaceable, and is configurable with air passages varying in size, shape, number, and spacing therebetween.

In an embodiment, the instrument has a body, wherein a portion of the body is recessed on a front edge, forming a cavity that has a lower surface, wherein the cavity receives the mouthpiece; a groove in the exterior bottom surface of the mouthpiece, in which the groove extends the length of the mouthpiece; and a tongue extending upward from the lower surface of the cavity. The tongue and groove mate with one another when an end of the mouthpiece is inserted into, or removed from, an open end of the cavity.

In an embodiment, the musical instrument has a mating component behind the mouthpiece to provide a seal to the mouthpiece and an interface to the pressure sensors. There is no airflow through the pressure sensors.

In an embodiment, the musical instrument has a percussive mode, a non-percussive mode, and a third mode. In the percussive mode, the instrument plays a set of notes at a predetermined volume of attack. In the non-percussive mode, the instrument plays each note based on an instantaneous air pressure at the mouthpiece. In the third mode, the instrument blends the percussive and non-percussive modes to play the notes, in which the notes have a pre-set trigger level.

In an embodiment, the musical instrument has a USB port that allows a user to charge the battery, and upload and download information.

In an embodiment, the musical instrument has on-board memory, allowing a user to save instrument set-up data.

In another embodiment of the present invention, a musical instrument has micro-electro-mechanical system (MEMS) pressure sensors that translate an air pressure to an electrical voltage; a mouthpiece, with air passages and vent holes, to channel air to the pressure sensors; a digital to analog converter to measure an electrical output of the pressure sensors; a user interface that allows a user to control the instrument; a microprocessor, that reads an electronic signal from the pressure sensors; a software program, that directs the microprocessor to perform a specific operation; an on-board sound-synthesis system that converts the electronic signal to sounds of a variety of instruments; a battery that provides power to the instrument; a charging system that charges the battery; a pressure transducer that triggers and controls the dynamics of a synthesized sound; and a guard-band in the center of the pressure transducer's range that prevents notes from being accidentally played. The guard-band is can be increased or decreased.

In an embodiment, the mouthpiece is removable and replaceable, and is configurable with air passages varying in size, shape, number, and spacing therebetween.

In an embodiment, the instrument has a body, wherein a portion of the body is recessed on a front edge, forming a cavity that has a lower surface, wherein the cavity receives the mouthpiece; a groove in the exterior bottom surface of the mouthpiece, in which the groove extends the length of the mouthpiece; and a tongue extending upward from the lower surface of the cavity. The tongue and groove mate with one another when an end of the mouthpiece is inserted into, or removed from, an open end of the cavity.

In an embodiment, the musical instrument has a mating component behind the mouthpiece to provide a seal to the mouthpiece and an interface to the pressure sensors. There is no airflow through the pressure sensors.

In an embodiment, the musical instrument has a percussive mode, a non-percussive mode, and a third mode. In the percussive mode, the instrument plays a set of notes at a predetermined volume of attack. In the non-percussive mode, the instrument plays each note based on an instantaneous air pressure at the mouthpiece. In the third mode, the instrument blends the percussive and non-percussive modes to play the notes, in which the notes have a pre-set trigger level.

In an embodiment, the musical instrument has a USB port that allows a user to charge the battery, and upload and download information.

In an embodiment, the musical instrument has on-board memory, allowing a user to save instrument set-up data.

In another embodiment of the present invention, a musical instrument has micro-electro-mechanical system (MEMS) pressure sensors that translate an air pressure to an electrical voltage; a mouthpiece that is removable and replaceable, and has air passages and vent holes, to channel air to the pressure sensors; a digital to analog converter to measure an electrical output of the pressure sensors; a user interface that allows a user to control the instrument; a microprocessor, that reads an electronic signal from the pressure sensors; a software program, that directs the microprocessor to perform a specific operation; an on-board sound-synthesis system that converts the electronic signal to sounds of a variety of instruments; a battery that provides power to the instrument; and a charging system that charges the battery.

In an embodiment, the mouthpiece is configurable with air passages varying in size, shape, number, and spacing therebetween.

In an embodiment, the instrument has a body, wherein a portion of the body is recessed on a front edge, forming a cavity that has a lower surface, wherein the cavity receives the mouthpiece; a groove in the exterior bottom surface of the mouthpiece, in which the groove extends the length of the mouthpiece; and a tongue extending upward from the lower surface of the cavity. The tongue and groove mate with one another when an end of the mouthpiece is inserted into, or removed from, an open end of the cavity.

In an embodiment, the musical instrument has a mating component behind the mouthpiece to provide a seal to the mouthpiece and an interface to the pressure sensors. There is no airflow through the pressure sensors.

In an embodiment, the musical instrument has a percussive mode, a non-percussive mode, and a third mode. In the percussive mode, the instrument plays a set of notes at a predetermined volume of attack. In the non-percussive mode, the instrument plays each note based on an instantaneous air pressure at the mouthpiece. In the third mode, the instrument blends the percussive and non-percussive modes to play the notes, in which the notes have a pre-set trigger level.

In an embodiment, the musical instrument has a USB port that allows a user to charge the battery, and upload and download information.

In an embodiment, the musical instrument has on-board memory, allowing a user to save instrument set-up data.

DETAILED DESCRIPTION OF THE INVENTION

Figure 1:
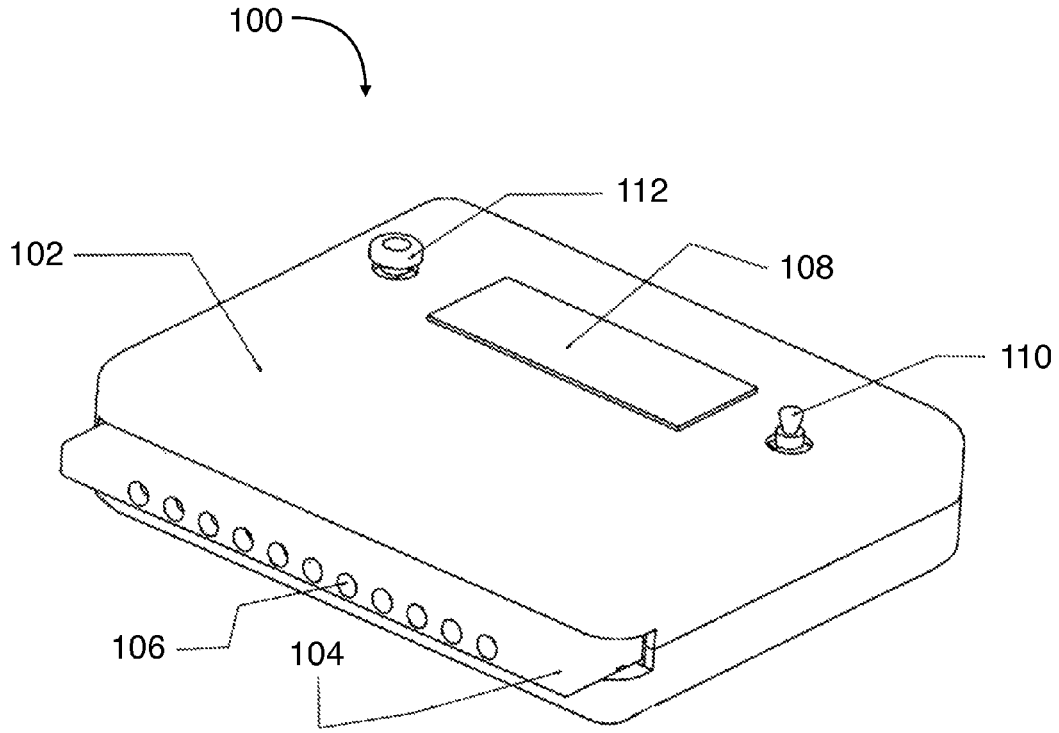
FIG. 1 shows a perspective view of the enclosure that houses the electronics, air pressure sensors, and power supply for the device, according to an embodiment of the present invention.

The current invention requires no reeds, there is no airflow through the sensor, and there are no moving parts in the air stream.

The mouthpiece, containing multiple holes, channels air to pressure sensors, which then translate that pressure to electrical voltages. To provide a simulation of the airflow through the mouthpiece (bleed), similar to a harmonica, holes are provided which can be tailored to the player's individual needs. The mouthpiece is removable and replaceable allowing for different hole spacing, shapes and bleed. Unlike mouthpieces designed for separate passages for blow and draw, the use of an ambient-referenced pressure sensor eliminates the need for separate passages and sensors, making the mouthpiece that is simple in design.

Behind the mouthpiece is a mating component, which provides a seal to the mouthpiece, and an interface to the pressure sensors. The sensors, referenced in above, are ambient-referenced, and convert the pressure from each hole into a DC voltage, which is read by a digital to analog converter.

The device described in this patent is not being used to measure and reproduce a vibration, but to trigger and control the dynamics of a synthesized sound.

Utilizing programmable System on Chip technology, analog to digital conversion, as well as menu system, memory, USB I/O and MIDI I/O are implemented on a single chip. Within this chip, analog signals from the pressure sensors are converted to a digital signal. A processor reads the signals from the pressure sensors and, depending on the configuration of the instrument, plays on-board sounds, sends MIDI signals to an external synthesizer, or both.

The instrument is configured by means of a user interface, which allows it to play percussive or non-percussive sounds with equal facility. In the percussive mode, each instrument is played at a pre-determined volume of attack. In the non-percussive mode, the instrument plays each note based on the instantaneous air pressure at the mouthpiece. A third mode is a blend of each of these, with a pre-set trigger level for the note.

All notes are independent of each other; this results in the ability to play one note loudly, and one note softly—with a skilled player able to vary the amount of air being sent to adjacent holes. As well as independent volume information, each hole may be assigned an individual instrument. This would permit, for example, a player to play a bass on one side of the instrument, while using the other side to play a flute, strings, or other lead instrument.

To simulate the operation of a chromatic harmonica, a joystick is provided. Depending on the user's configuration of the instrument, the joystick can be used to shift notes up, down, or both. Unlike a typical chromatic harmonica, this feature permits a total of 66 notes in an eleven-hole instrument.

The joystick may be configured to offer other features as well, such as pitch-bend, program changes, insertion of effects, key changes and any other feature added to the harmonica. The user interface may consist of either an LCD screen and a rotary encoder for user input, or a touch-screen display.

On-board memory permits the user to save complete instrument set-up data, which may be recalled during performances, and accessed in real time by the joystick. When the instrument is configured as a sequencer, performance data may be recorded for future playback.

This instrument places sound synthesis within the body of the instrument. A headphone jack, as well as a line-out jack, permit the instrument to be used in privacy, or to be connected to an amplification system.

A USB port is part of the instrument that permits charging of internal batteries, and uploading or downloading settings, program information, or to upgrade the resident firmware as new features are developed.

Referring to FIG. 1, Body 102: Approx. 6"×6"×1" two-piece (top and bottom) enclosure with rounded filleted edges and corners. Body 102 (top) has holes cut out for LCD display 108, joystick 110, as well as rotary encoder 112 navigation and selector knobs. Body 102 has front end open with slot and tongue to allow insertion of removable and interchangeable mouthpiece 104 with matching groove. Preferred material is ABS plastic, brushed aluminum or exotic wood. Mouthpiece 104 has eleven holes or chambers but other models could have ten holes and as many as twenty holes that may vary in size and shape according to a players needs. Mouthpiece 104 is removable and replaceable so the instrument can be played by more than one player without the fear of germ transmission. There are eleven small air holes on the bottom of mouthpiece 104 located under each chamber to allow for inhaled and exhaled airflow adding more comfort and playability. Preferred material is ABS plastic, Delmar, or exotic woods. Approximate size is 6"×1"×⅜". Air holes 106. Round, square or hexagon shaped, approximately ¼" in diameter and 1" in length. Holes 106 are evenly spaced and can be designed further apart or closer together depending on desired results. Closer holes may be used for chords and further spaced holes used for soloing. LCD Display 108 is backlit and used to display menu choices such as scale, key, instrument and so forth. Joystick 110 is used mostly in live performance mode to quickly change from pre-saved menu choices and also used as a pitch bend up or down allowing full chromatic scales. Joystick 110 may be further used to add effects such as tremolo, vibrato, or distortion. Rotary encoder 112 is designed to access menu, scroll through menu items and add titles to favorite patches stored in various banks on chip.

Figure 2:
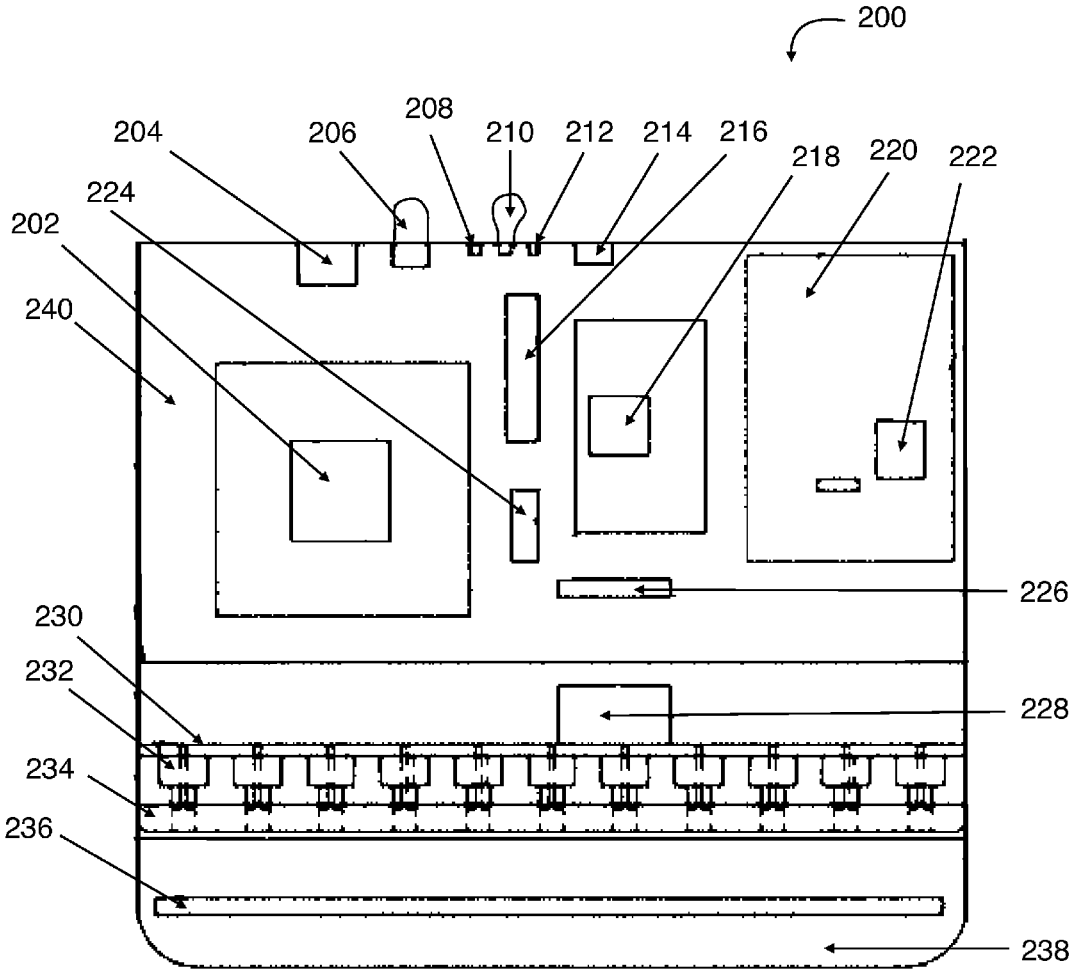
FIG. 2 shows a bottom plan view of the interior of the instrument; according to an embodiment of the present invention.

Referring to FIG. 2, Processor system on chip 202. MIDI out jack 204 for connecting to other MIDI instruments. Volume knob potentiometer 206 is used for adding or lowering volume. Audio out jack 208 for connecting to an outboard amplifier or PA system. Power switch 210 for turning instrument on and off. Headphone jack 212 for connecting headphones. USB jack interface 214 for connecting to computer for updates and program changes. Display connector 216 connects LCD display via ribbon cable. Power supply area 218 contains voltage regulator and battery. Audio processing area 220. On board synthesizer 222 for internal sounds. User interface jack 224 as an optional way to communicate with computer. Sensor PCB connector 226 for ribbon cable to connect to sensor board. Sensor connector 228 connects sensor board to main PC board. Sensor PC board 230 housing air pressure sensors and caps and filters. Pressure sensors 232 used to detect change in air pressure that determines how loud or soft a note or sound will be played. Sensor manifold 234 aligns and holds sensor nipple for exact match up with removable mouthpiece. Tongue 236 accepts the groove on bottom of replaceable mouthpiece and assures sealed alignment with mouthpiece. Lower half of body enclosure 238. Main circuit board 240 houses and interconnects all components and power supply.

Figure 3:
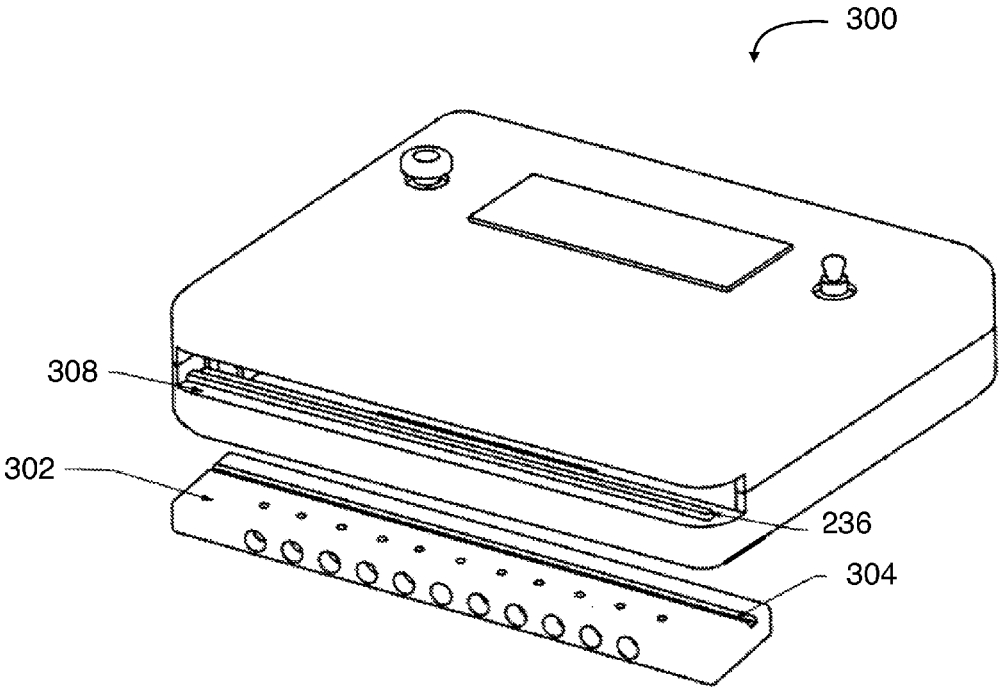
FIG. 3 shows a perspective view of the instrument, with a removable eleven holed mouthpiece, according to an embodiment of the present invention.

Referring to FIG. 3, mouthpiece 302 is shown bottom-side up to reveal slot for mating to enclosure. Mouthpiece 302 with eleven holes evenly spaced. Number of holes could vary when additional notes or sounds are needed. Shapes of holes may be round, square oval, or hexagon shaped. Preferred material is ABS plastic but works well with exotic woods and other plastics. As shown in drawing mouthpiece 302 is totally removable and can be replaced with different configurations of spacing and shapes of shafts. Slot 304 running the length of mouthpiece 302 designed to mate with tongue 236. Tongue 236 which is part of lower half of enclosure FIG. 2. Designed to mate with groove or slot in mouthpiece 302. Channel 308 cut into upper and lower enclosure FIG. 1. Channel 308 designed to accept removable mouthpiece 302.

Figure 4:
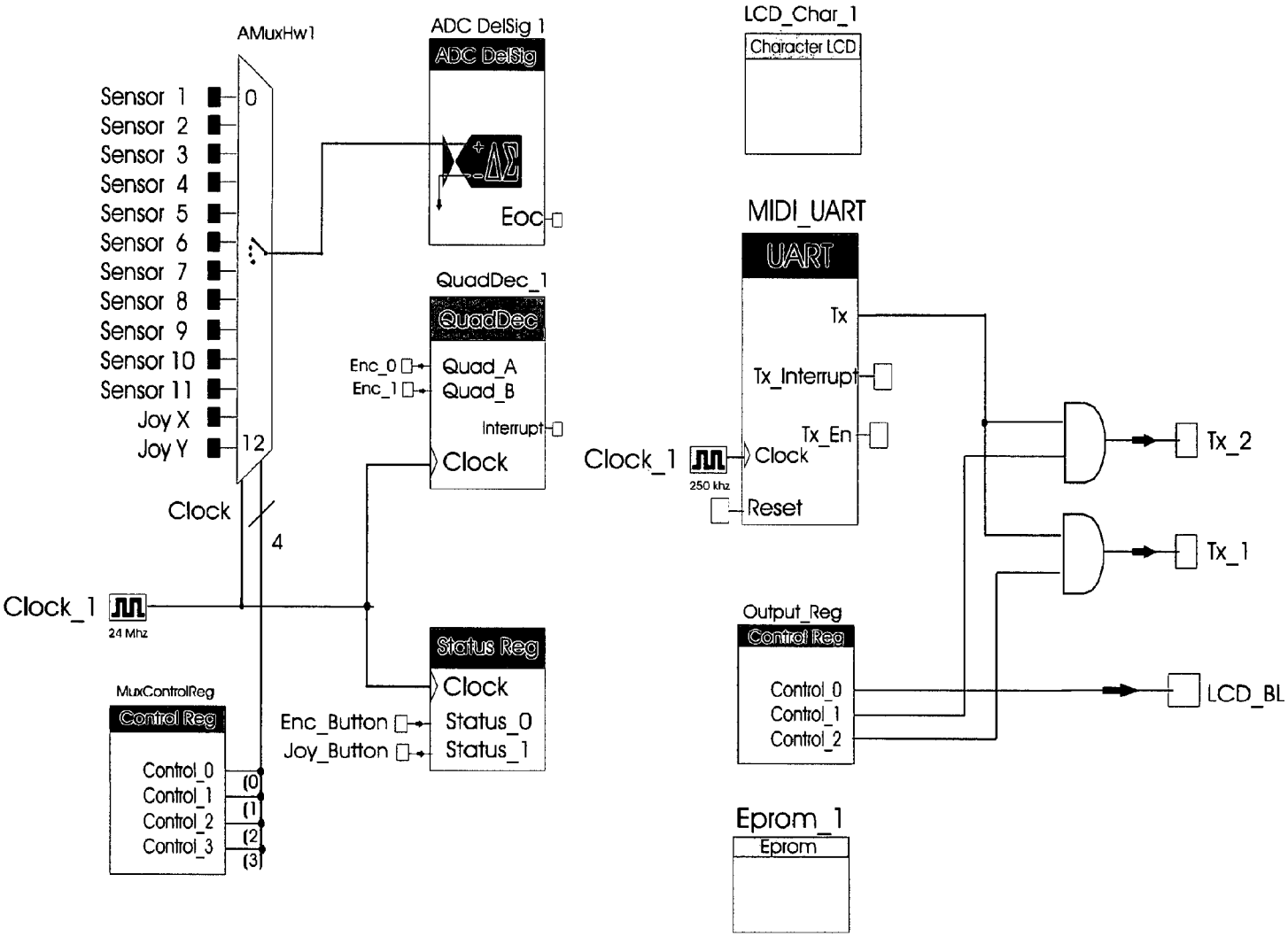
FIG. 4 shows a diagram of the analog/digital programmable system, which may be located on a chip, according to one embodiment of the present invention.

Referring to FIG. 4, input signals from individual sensors and the Joystick multiplexed and converted to digital via the Delta Sigma Analog to Digital converter. A control register is used to address the multiplexer, selecting the desired input signal. In those systems where the input device is a rotary encoder, a quadrature decoder is utilized to determine the user activity at that device. Inputs from the pushbuttons are read via a status register. The Character LCD segment controls the LCD display. A similar segment of hardware will control a color LCD touch-screen display in those models. EEPROM is utilized to save user settings.

The combination of the UART and a second control register are utilized to send MIDI information, selectively, to either the internal or an external synthesizer.

What is claimed is:

1. A musical instrument comprising:

a. a plurality of micro-electro-mechanical system (MEMS) pressure sensors, configured to translate an air pressure to an electrical voltage;

b. a mouthpiece, having a plurality of air passages and vent holes, configured to channel air to the pressure sensors;

c. a digital to analog converter, configured to measure an electrical output of the pressure sensors;

d. a user interface, configured to allow a user to control the instrument;

e. a microprocessor, configured to read an electronic signal from the pressure sensors;

f. a software program, configured to direct the microprocessor to perform a specific operation;

g. an on-board sound-synthesis system, configured to convert the electronic signal from the pressure sensors to sounds of a variety of instruments;

h. a battery, configured to provide power to the instrument;

i. a charging system, configured to charge the battery; and j. a drip tray beneath the mouthpiece, configured to retain moisture escaping from the plurality of vent holes.

2. The musical instrument of claim 1, wherein the mouthpiece is removable and replaceable, wherein the mouthpiece is configurable with air passages varying in size, shape, number, and spacing therebetween.

3. The musical instrument of claim 2, further comprising:

a. an instrument body, wherein a portion of the body is recessed on a front edge of the body, forming a cavity having a lower surface, wherein the cavity is configured to receive the mouthpiece;

b. a groove in an exterior bottom surface of the mouthpiece, wherein the groove extends the length of the mouthpiece; and c. a tongue extending upward from the lower surface of the cavity, wherein the tongue and groove are configured to mate when an end of the mouthpiece is inserted into, or removed from, an open end of the cavity.

4. The musical instrument of claim 1, further comprising a mating component in communication with the mouthpiece, configured to provide a seal to the mouthpiece and an interface to the pressure sensors, wherein there is no air flow through the pressure sensors.

5. The musical instrument of claim 1, wherein the instrument has a percussive mode, a non-percussive mode, and a third mode, wherein in the percussive mode, the instrument is configured to play a set of notes at a pre-determined volume of attack, and wherein in the non-percussive mode, the instrument is configured to play each note based on an instantaneous air pressure at the mouthpiece, and wherein in the third mode, the instrument is configured to blend the percussive and non-percussive modes to play the notes, wherein the notes have a pre-set trigger level.

6. The musical instrument of claim 1, further comprising a USB port, configured to allow a user to charge the battery, and upload and download information.

7. The musical instrument of claim 1, further comprising on-board memory, configured to save instrument set-up data.

8. A musical instrument comprising:

a. a plurality of micro-electro-mechanical system (MEMS) pressure sensors, configured to translate an air pressure to an electrical voltage;

b. a mouthpiece, having a plurality of air passages, configured to channel air to the pressure sensors;

c. a digital to analog converter, configured to measure an output of the pressure sensors;

d. a user interface, configured to allow a user to control the instrument;

e. a microprocessor, configured to read an electronic signal from the pressure sensors;

f. a software program, configured to direct the microprocessor to perform a specific operation;

g. an on-board sound-synthesis system, configured to convert the electronic signal from the pressure sensors to sounds of a variety of instruments;

h. a battery, configured to provide power to the instrument;

i. a charging system, configured to charge the battery;

j. a pressure transducer, configured to trigger and control the dynamics of a synthesized sound; and k. a guard-band in the center of the pressure transducer's range, configured to prevent notes from being accidentally played, and wherein the guard-band is configured to be increased or decreased.

9. The musical instrument of claim 8, wherein the mouthpiece is removable and replaceable, wherein the mouthpiece is configurable with air passages varying in size, shape, number, and spacing therebetween.

10. The musical instrument of claim 9, further comprising:

a. an instrument body, wherein a portion of the body is recessed on a front edge of the body, forming a cavity having a lower surface, wherein the cavity is configured to receive the mouthpiece;

b. a groove in an exterior bottom surface of the mouthpiece, wherein the groove extends the length of the mouthpiece; and c. a tongue extending upward from the lower surface of the cavity, wherein the tongue and groove are configured to mate when an end of the mouthpiece is inserted into, or removed from, an open end of the cavity.

11. The musical instrument of claim 8, further comprising a mating component in communication with the mouthpiece, configured to provide a seal to the mouthpiece and an interface to the pressure sensors, wherein there is no air flow through the pressure sensors.

12. The musical instrument of claim 8, wherein the instrument has a percussive mode, a non-percussive mode, and a third mode, wherein in the percussive mode, the instrument is configured to play a set of notes at a pre-determined volume of attack, and wherein in the non-percussive mode, the instrument is configured to play each note based on an instantaneous air pressure at the mouthpiece, and wherein in the third mode, the instrument is configured to blend the percussive and non-percussive modes to play the notes, wherein the notes have a pre-set trigger level.

13. The musical instrument of claim 8, further comprising a USB port, configured to allow a user to charge the battery, and upload and download information.

14. The musical instrument of claim 8, further comprising on-board memory, configured to save instrument set-up data.

15. A musical instrument comprising:

a. a plurality of micro-electro-mechanical system (MEMS) pressure sensors, configured to translate an air pressure to an electrical voltage;

b. a mouthpiece, having a plurality of air passages and vent holes, configured to channel air to the pressure sensors, wherein the mouthpiece is removable and replaceable;

c. a digital to analog converter, configured to measure an output of the pressure sensors;

d. a user interface, configured to allow a user to control the instrument;

e. a microprocessor, configured to read an electronic signal from the pressure sensors;

f. a software program, configured to direct the microprocessor to perform a specific operation;

g. an on-board sound-synthesis system, configured to convert the electronic signal from the pressure sensors to sounds of a variety of instruments;

h. a battery, configured to provide power to the instrument; and i. a charging system, configured to charge the battery.

16. The musical instrument of claim 15, wherein the mouthpiece is configurable with air passages varying in size, shape, number, and spacing therebetween.

17. The musical instrument of claim 16, further comprising:

a. an instrument body, wherein a portion of the body is recessed on a front edge of the body, forming a cavity having a lower surface, wherein the cavity is configured to receive the mouthpiece;

b. a groove in an exterior bottom surface of the mouthpiece, wherein the groove extends the length of the mouthpiece; and c. a tongue extending upward from the lower surface of the cavity, wherein the tongue and groove are configured to mate when an end of the mouthpiece is inserted into, or removed from, an open end of the cavity.

18. The musical instrument of claim 15, further comprising a mating component in communication with the mouthpiece, configured to provide a seal to the mouthpiece and an interface to the pressure sensors, wherein there is no air flow through the pressure sensors.

19. The musical instrument of claim 15, wherein the instrument has a percussive mode, a non-percussive mode, and a third mode, wherein in the percussive mode, the instrument is configured to play a set of notes at a pre-determined volume of attack, and wherein in the non-percussive mode, the instrument is configured to play each note based on an instantaneous air pressure at the mouthpiece, and wherein in the third mode, the instrument is configured to blend the percussive and non-percussive modes to play the notes, wherein the notes have a pre-set trigger level.

20. The musical instrument of claim 15, further comprising on-board memory, configured to save instrument set-up data.

* * * * *